US005929885A

United States Patent [19]

Nakajima et al.

[11] Patent Number: 5,929,885

[45] Date of Patent: Jul. 27, 1999

[54] INK CONSUMPTION DETECTION USING A PHOTOSENSOR WITH A LIGHT-TRANSMISSIVE INK CONTAINER

[75] Inventors: Kazuhiro Nakajima; Masanori Takenouchi, both of Yokohama; Yasuo Kotaki, Tokyo, all of Japan

[73] Assignee: Canon Kabushiki Kaisha, Tokyo, Japan

[21] Appl. No.: 08/189,848

[22] Filed: Feb. 1, 1994

[30] Foreign Application Priority Data

Feb. 3, 1993 [JP] Japan ..... 5-016421

[51] Int. Cl.[6] ..... B41J 2/175

[52] U.S. Cl. ..... 347/87; 347/7

[58] Field of Search ..... 347/7, 87, 86; 250/577, 573

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,920,362 | 4/1990 | Cowger | 347/87 |
| 5,102,251 | 4/1992 | Kaufmann | 401/151 |
| 5,216,450 | 6/1993 | Koitabashi et al. | 347/87 |
| 5,241,189 | 8/1993 | Vandagriff et al. | 347/7 |
| 5,430,471 | 7/1995 | Nakajima et al. | 347/87 |

FOREIGN PATENT DOCUMENTS

| | | | |
|---|---|---|---|
| 0393320 | 10/1990 | European Pat. Off. . | |
| 0542247 | 5/1993 | European Pat. Off. . | |
| 49-124918 | 10/1974 | Japan . | |
| 58-194551 | 11/1983 | Japan . | |
| 58-194552 | 11/1983 | Japan . | |
| 59-123670 | 7/1984 | Japan . | |
| 59-138461 | 8/1984 | Japan . | |
| 61-107286 | 7/1986 | Japan . | |
| 62-21549 | 1/1987 | Japan | 347/7 |
| 62-25052 | 2/1987 | Japan . | |
| 62-152859 | 7/1987 | Japan . | |
| 62-156964 | 7/1987 | Japan | 347/7 |
| 63-013733 | 1/1988 | Japan . | |
| 63-115757 | 5/1988 | Japan . | |
| 63-252747 | 10/1988 | Japan | 347/7 |
| 05131642 | 5/1993 | Japan . | |
| 05201021 | 8/1993 | Japan . | |

OTHER PUBLICATIONS

Webster's II New Riverside University Dictionary, 1988, p. 304.

*Primary Examiner*—N. Le
*Assistant Examiner*—Judy Nguyen
*Attorney, Agent, or Firm*—Fitzpatrick, Cella, Harper & Scinto

[57] ABSTRACT

An ink-jet recording apparatus has an ink container which has a plurality of defined chambers for containing ink and a detecting device which detects the residual ink quantity in the chambers. The detecting device has photosensors fixed in the recording apparatus which can detect the residual ink quantity in the chambers optically based on an amount of light passing through the chambers. As the ink container moves with a printhead carried by a carriage, the photosensors detect the residual ink quantities in the chambers one after another, whereby a simple detecting device for an ink container having multiple ink chambers can be provided.

18 Claims, 18 Drawing Sheets

INK CONSUMPTION DETECTION USING A PHOTOSENSOR WITH A LIGHT-TRANSMISSIVE INK CONTAINER

BACKGROUND OF THE INVENTION

1. Field of the Invention

This invention relates to detecting consumption of fluid from a container and, more particularly, to detecting a decrease in the amount of ink in an ink container of a recording apparatus such as an ink jet printer, a copying apparatus or a facsimile machine.

2. Related Background Art

In an ink jet recording apparatus, it is preferable that ink at a recording head ejection port is maintained at a suitable negative pressure in order to provide stable ink discharge from the ejection port, and to prevent ink leakage from the ejection port when the recording apparatus is not recording. One method of providing this pressure condition involves maintaining the ink level in an ink container lower than the recording head. With that method, however, the apparatus must be kept in a predetermined orientation during recording because gravity is used to maintain the desired pressure condition.

Another consideration involved in designing an ink jet recording apparatus is the importance of monitoring ink consumption, that is, being able to detect a decrease in the amount of ink in the ink container. Typically, the ink level in the ink container can be determined, for example, by using a float, or by detecting a change of impedance between electrodes located in the ink container so they are exposed by degrees as the ink level drops.

In addition it has been desired in recent years to provide a smaller, more portable ink jet printer. To that end, an ink container carried on a carriage for moving a recording head has been used instead of an ink container separate from the carriage.

Two conventional ink containers, which generate a suitable negative pressure and so can prevent ink leakage from the ink ejection port when the printer is not recording, are shown in FIGS. 1 and 2.

As shown in FIG. 1, the ink container 201 is divided into three chambers 206, 207 and 208 by two partition walls 202*a* and 202*b*. The chambers 206, 207 and 208 communicate with each other through small diameter orifices 203*a* and 203*b* formed in the partition walls 202*a* and 202*b*. The first chamber 206 communicates at the bottom with an ink well 209 having a supply port 205 for supplying ink to an ink droplet producer with an ejection outlet (for example, a recording head). The third chamber 208 communicates at the bottom with an overflow sump 211 through an orifice 203*c* and a drop pipe 210. The overflow sump 211 communicates with the atmosphere through a standpipe vent 204.

During recording, an amount of ink corresponding to the ink consumed by the ink droplet producer 205 is supplied to the first chamber 206 from the second chamber 207 through the orifice 203*a*. Ink is supplied to the second chamber 207 from the third chamber 208 through the orifice 203*b*. As a result, the internal pressure of the third chamber 208 decreases. When the internal pressure reaches a threshold level, air is supplied to the third chamber 208 through the orifice 203*c*. The internal pressure of the chambers is thus automatically controlled. If, however, the internal pressure in the ink container 201 should increase due to a change in ambient conditions, such as a temperature increase, ink flows into the overflow sump 211 through the pipe 210, and therefore ink will not leak from the ink droplet producer.

Referring to FIG. 2, an ink container of an ink cartridge 301 is filled substantially entirely with a porous material 303 which retains ink. Adjacent one end of the porous material 303, there is an ink supply port 306, which is in communication with an ink ejection port 305 through a supply pipe, and adjacent the other end, there is an air vent 304, which communicates the inside of the container with the atmosphere through a cavity 302. Plural ribs (not shown) on an inner wall of the ink cartridge 301 farthest from the ink ejection port 305 provide space for atmospheric pressure to act on an enlarged area of the porous material 303. The negative pressure at the ejection port 305 is maintained by the capillary force provided by the porous material 303, so that ink does not leak out through the ink ejection port.

In the structure of FIG. 1, the plural ink chambers communicate with each other through orifices small enough to produce capillary force, and therefore clogging can occur if the ink contains foreign matter or precipitates. In addition, this type of ink container must have an overflow sump with a capacity that can accommodate the worst possible ambient conditions, in order to assure safe use no matter how much the air in the ink chamber expands due to changes in pressure, temperature or the like. However, ink may still leak through the vent 204 under certain conditions. The small diameter orifices 203*a* and 203*b* must be precisely dimensioned such that ink does not leak through the ejection outlet, air and ink do not flow simultaneously through those orifices, and efficient ink supply is not impeded. Finally, it is difficult to detect a decrease in the amount of ink in such an ink container because of its plural chambers. Accordingly, this structure both presents operational problems and is difficult to manufacture.

In the structure of FIG. 2 the ink is retained in the porous material and the orientation of the ink container thus is not restricted, as it is with the container shown in FIG. 1. However, the porous member reduces the amount of ink the container can accommodate and also retains a significant amount of non-usable ink. In addition, retaining the ink in a porous material makes it difficult to detect a decrease in the amount of ink from outside of the ink container. That is, accurately detecting a decrease in the amount of ink on the basis of a change of impedance between electrodes provided in the porous material is difficult, since the distribution of ink in the porous material is usually not uniform and the magnitude of the change in the impedance between the electrodes as the ink is used may not be sufficient to give an accurate reading of the amount of ink remaining. Accordingly, the conventional constructions shown in FIGS. 1 and 2 are not entirely satisfactory.

SUMMARY OF THE INVENTION

The present invention is designed to overcome the problems encountered with conventional structure.

It is accordingly an object of the invention simply and accurately to detect a decrease in the amount of ink in an ink container in which ink leakage is inhibited even with changing ambient conditions and orientation of the container, and in which the volume efficiency of the container is high.

Another object of this invention is provide a detecting device comprising an ink container having at least one partition dividing the container into plural ink chambers connected in a series through an ink path in each partition, an air vent for communicating a first ink chamber with the atmosphere and an ink supply port for supplying ink from a second ink chamber, wherein the ink path in each partition provides for an ink flow to the supply port that empties each chamber in the series in turn as ink is supplied from the supply port and at least one of the chambers includes a light-transmissible portion, and at least one photosensor for optically detecting ink through the light-transmissible portion.

Yet another object of the invention is to provide an ink jet recording apparatus with such a detecting device.

Still another object of the invention is to provide a detecting method comprising the steps of providing an ink container having at least one partition dividing the container into plural ink chambers connected in a series through an ink path in each partition, an air vent for communicating a first ink chamber with the atmosphere and an ink supply port for supplying ink from a second ink chamber, wherein the ink path in each partition provides for an ink flow to the supply port that empties each chamber in the series in turn as ink is supplied from the supply port and at least one of the chambers includes a light-transmissible portion, and optically detecting ink through the light-transmissible portion using a photosensor.

BRIEF DESCRIPTION OF THE DRAWINGS

Various aspects of the present invention can be best understood by reference to the detailed description of preferred embodiments set forth below taken with the drawings, in which.

DETAILED DESCRIPTION OF THE PREFERRED EMBODIMENTS

Examples of ink containers applicable to this invention will first be described.

Figure 1:
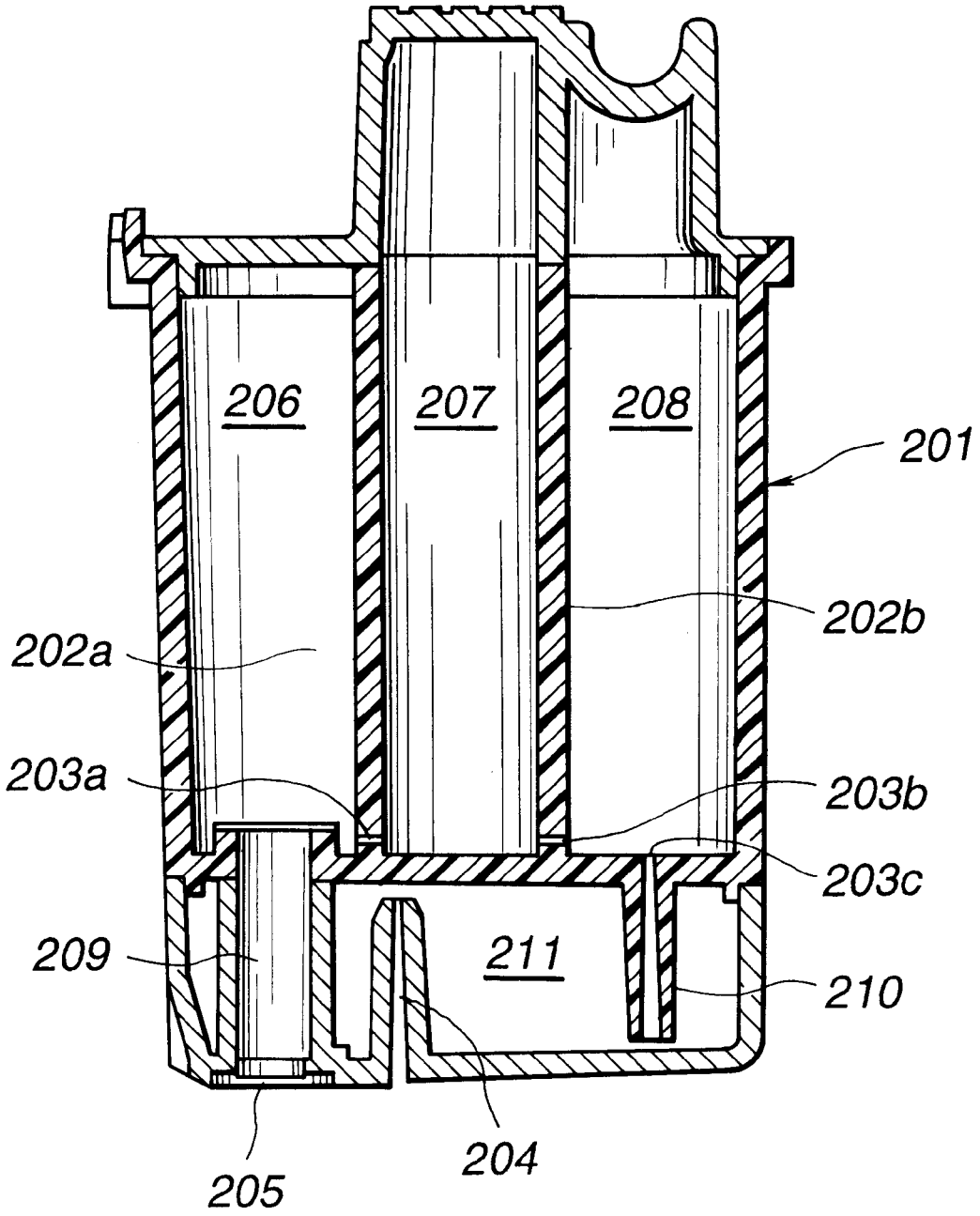
FIG.1 (PRIOR ART)
FIG. 1 is a sectional view of one type of conventional ink container.
Figure 2:
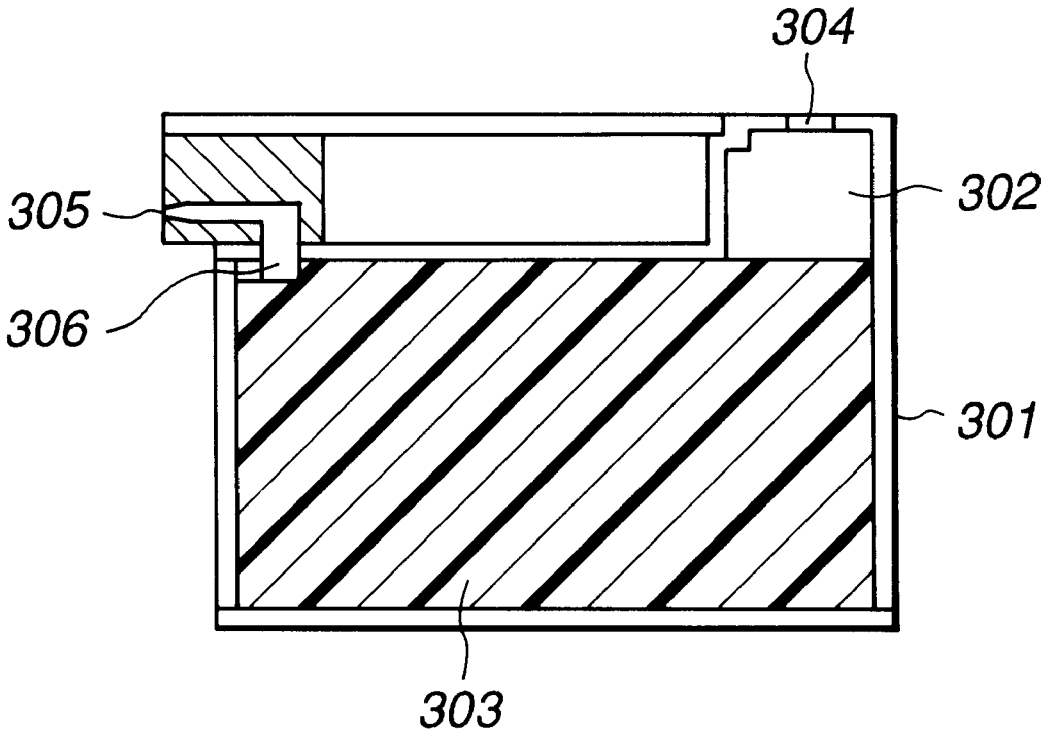
FIG.2 (PRIOR ART)
FIG. 2 is a sectional view of another type of conventional ink container.
Figure 3:
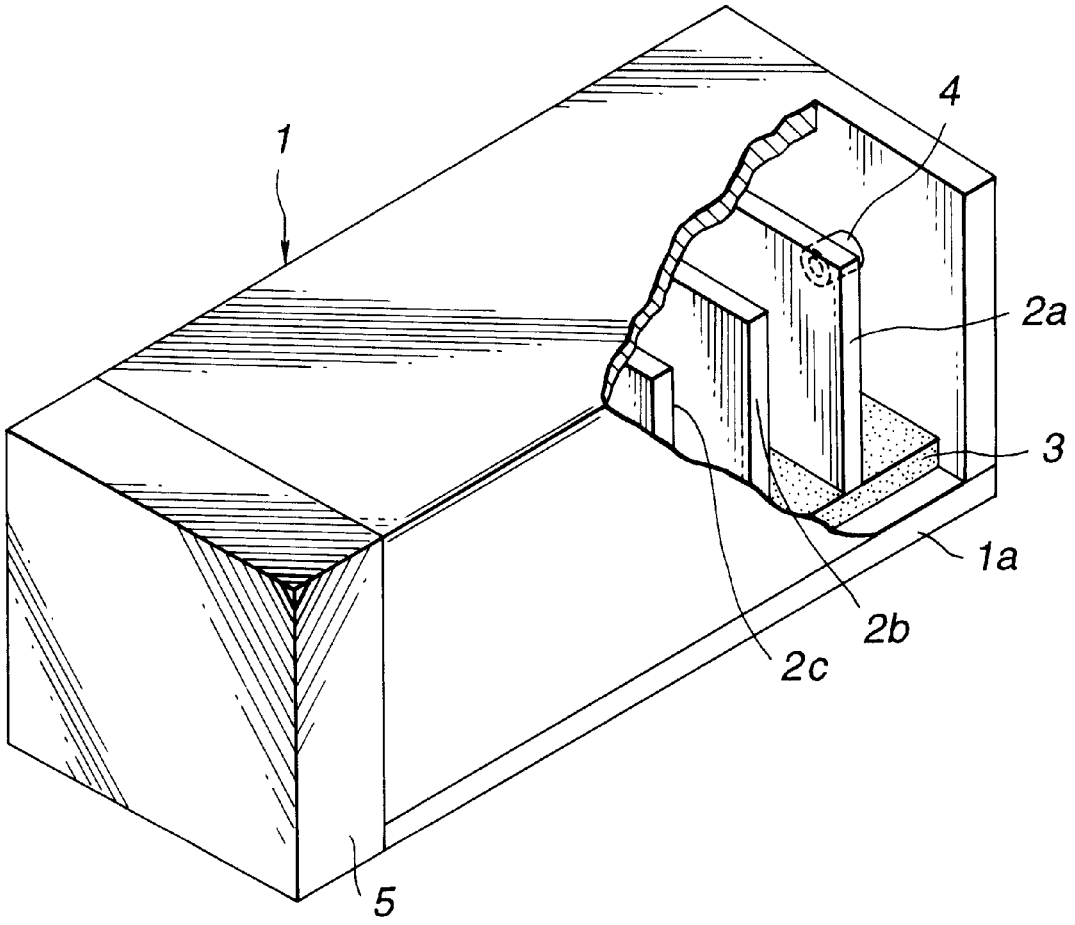
FIG. 3 is perspective view, partly broken away, of a first example of an ink container applicable to the present invention.
Figure 4:
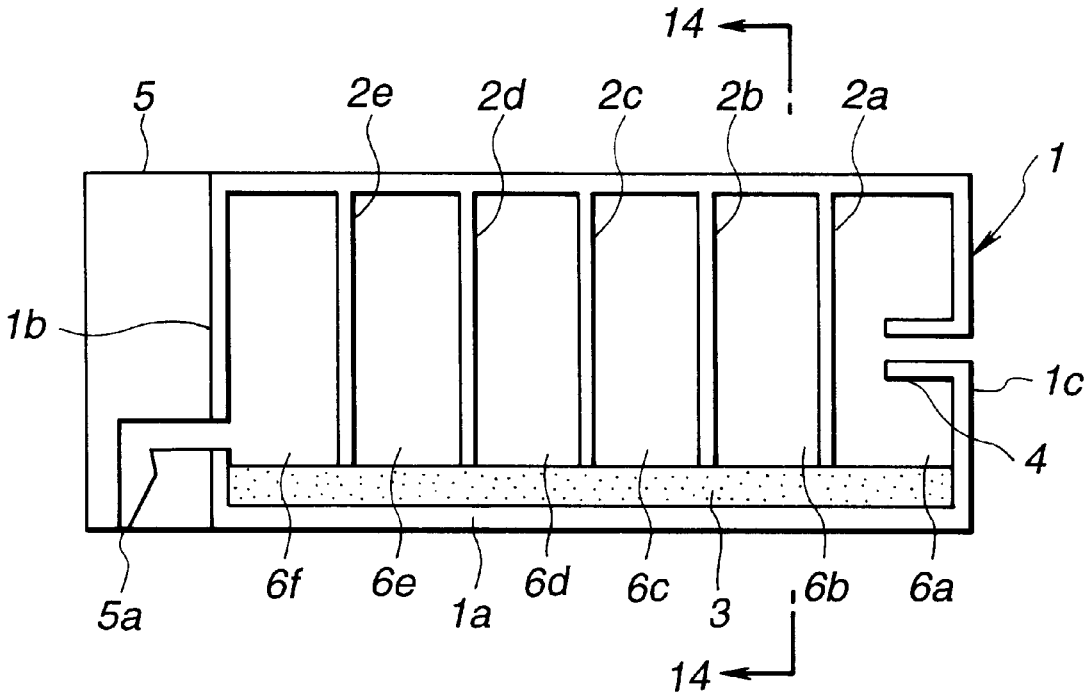
FIG. 4 is a sectional view of the ink container shown in FIG. 3.

FIG. 3 is a perspective view of a first example of such an ink container, with the walls broken away to show part of the container's internal structure. FIG. 4 is a longitudinal sectional view of the same ink container.

In this first example, the ink container is used with a recording head 5 which ejects the ink to a recording material such as a sheet of paper. However, the recording head may be a separate member which is removably mounted to the liquid container.

As shown in FIGS. 3 and 4, the bottom wall 1*a* of the main body 1 of the container is provided with a porous layer member 3 made of an absorbent material such as sponge or the like. The container is divided into a series of six chambers 6*a*, 6*b*, 6*c*, 6*d*, 6*e* and 6*f* by partition plates 2*a*, 2*b*, 2*c*, 2*d* and 2*e* that leave an opening between each partition plate and the bottom wall, as seen in FIG. 4. That is, each partition plate forms with the bottom wall an opening that provides an ink path between two of the chambers, and the openings are filled by the porous member 3. If the main body 1 is a transparent or other light-transmissive material, the amount of remaining ink will be apparent therethrough.

The recording head 5, with an ink discharge port 5*a*, is mounted on an outer surface of the front wall 1*b* and is supplied with ink through a supply port in chamber 6*f*. An air vent 4 is provided on an outer surface of the back wall 1*c*. The air vent 4 is in the form of a tube extending to the center of the first chamber 6*a*. Therefore, even if there is ink in the first chamber 6*a*, it does not leak out, regardless of the orientation of the ink container, unless the volume of the ink exceeds half the volume of the first chamber 6*a*.

The manner in which ink is fed from the ink container during a recording operation will be described with reference to FIG. 5.

The ink container is mounted during the recording operation with the porous member 3 disposed at the bottom of the ink container, as shown in FIG. 5.

Figure 5A:
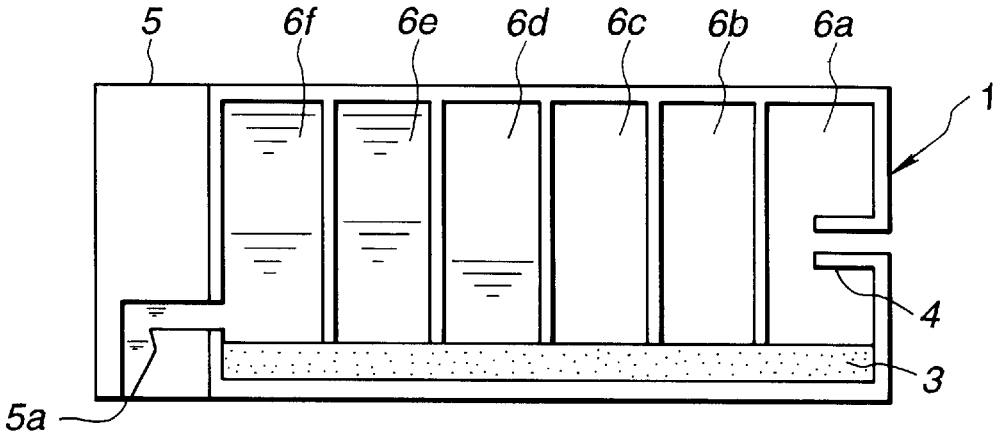
FIGS. 5A, 5B and 5C are sectional views illustrating consumption of the ink in the ink container shown in FIGS. 3 and 4.

At the initial stage, all of the chambers of the ink container, except for the first chamber 6*a* having the air vent 4, are filled with ink. During printing, the chambers are emptied in turn from the second chamber 6*b* to the sixth chamber 6*f*, one after another in series, as illustrated in FIG. 5A.

The reason the container empties in that manner is as follows. The ejection port 5*a* discharges ink contained in the sixth chamber 6*f* closest to the recording head 5. Since the sixth chamber 6*f* is in flow communication with the fifth chamber 6*e* only through the porous member 3, an amount of ink corresponding to that ejected from the ejection port 5*a* is introduced from the fifth chamber 6*e* to the sixth chamber 6*f* through the porous member 3.

Similarly, the same amount of ink is supplied to each downstream chamber from the next adjacent upstream chamber, so that ink is supplied continuously through the chambers to the ejection port 5*a*. A space having a volume corresponding to the consumed ink is simultaneously formed by air supplied through the air vent 4 and the porous member 3. Thus, the chambers are emptied of ink sequentially in turn, starting with the chamber closest to the air vent 4. Since each chamber is connected to another only through the porous member 3, a slight negative pressure of the ink in the container is maintained by the many fine meniscuses formed by the ink in the porous member 3.

The container also efficiently retains ink when a printing operation is not being performed. With variations in ambient conditions, particularly the ambient temperature or pressure, air in the container expands much more than the ink. For example, if the temperature increases with the container in the state shown in FIG. 5A, even if the air in the first chamber 6*a*, the second chamber 6*b* and the third chamber 6*c* expands, those chambers readily vent to the outside because there is little ink in the porous material 3 in those three chambers and the air in those chambers thus communicates with the ambient atmosphere through the air vent 4, whereby the expanding air does not put pressure on ink in the recording head 5.

However, expansion of the air above the ink in the fourth chamber 6*d* will discharge ink from the fourth chamber 6*d* to the third chamber 6*c*. The ink thus discharged to the third chamber 6*c* flows toward the first chamber 6*a* through the porous material 3, which results in isolating the air in the third chamber 6*c* and the second chamber 6*b*, and, as shown in FIG. 5B, the ink enters the first chamber 6*a*.

It will be understood that the volume of ink flowing into the first chamber 6*a* is determined only by the volume of the ink in the chamber or chambers that contain both ink and air therein prior to the temperature rise (chamber 6*d* in this example). In view of this, the volume of the first chamber 6*a* is determined such that it has a proper ratio relative to the volume of the other chambers 6*b*–6*f* in consideration of the expected ranges of temperature and pressure to which the container will be subjected.

Figure 5B:
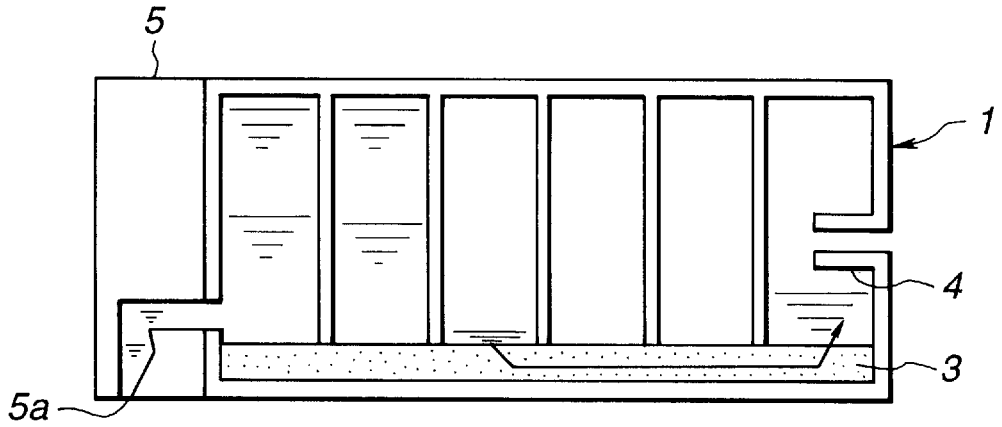
Figure 5C:
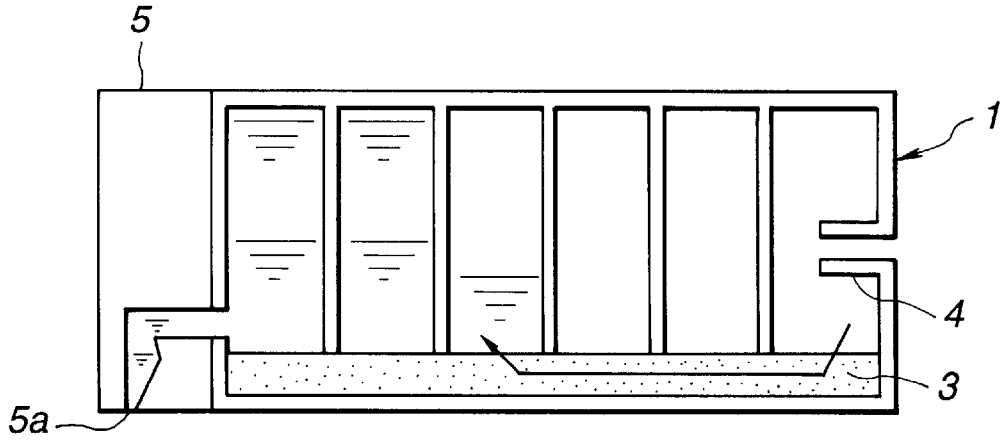

When the temperature decreases in the state shown in FIG. 5B, the ink moved to the first chamber 6*a* is sucked back into the chambers 6*b*–6*d* with the contraction of the air, since those chambers are disconnected from the external atmosphere. Finally, the state shown in FIG. 5C, which corresponds to the initial state shown in FIG. 5A, is reached.

The above-described ink retention during non-printing is independent of the amount of the ink in the container. That is, if it were chamber 6*e* that was partially full, ink would still flow to the first chamber 6*a* as described above in connection with FIG. 5B. If, however, the container is oriented in another position, say upside down, the ink does not contact the porous material 3 at all, and no overflow to the first chamber 6*a* occurs despite any temperature rise, since all of the chambers communicate with the external air atmosphere.

As described in the foregoing, even if ambient conditions such as temperature or pressure or the like change, the ink container can be oriented in almost any position and still be restored to its original state when ambient conditions are restored.

Figure 6:
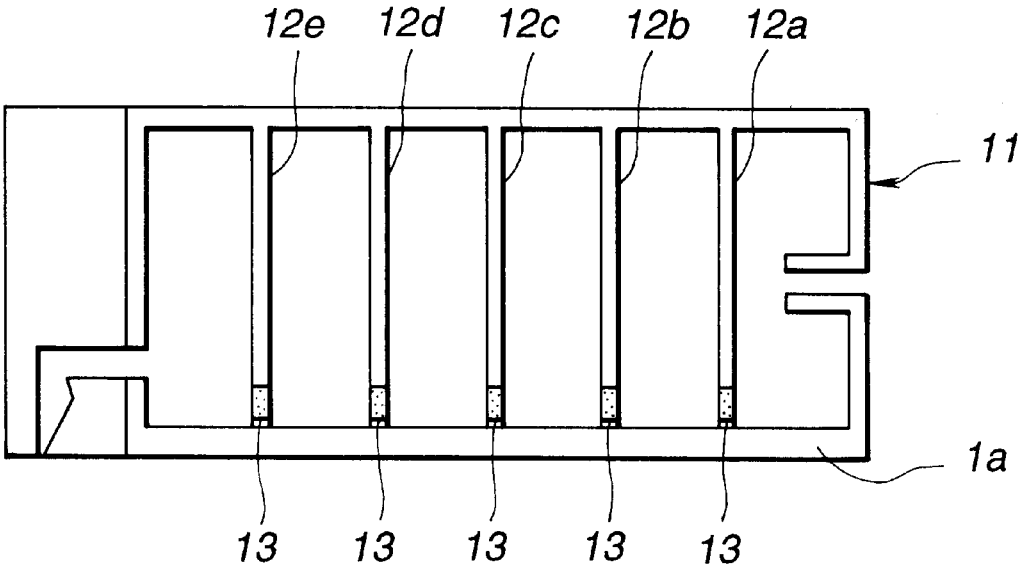
FIG. 6 is a sectional view of a second example of an ink container applicable to the present invention.

FIG. 6 is a longitudinal sectional view of a second example of an ink container applicable to the present invention.

In this example, porous members 13 are provided only between the bottom wall la of the container body 11 and each partition plate 12*a*, 12*b*, 12*c*, 12*d* and 12*e*. According to this example, the amount of porous material is smaller than in the example shown in FIGS. 3 and 4, and the amount of usable ink is accordingly increased. In the ink container shown in FIG. 6, that is, with the porous members 13 only at the bottoms of the chamber walls, even if ambient conditions such as temperature or pressure or the like change, the ink will move in a fashion similar to that discussed above in connection with FIGS. 5A–5C.

Figure 7:
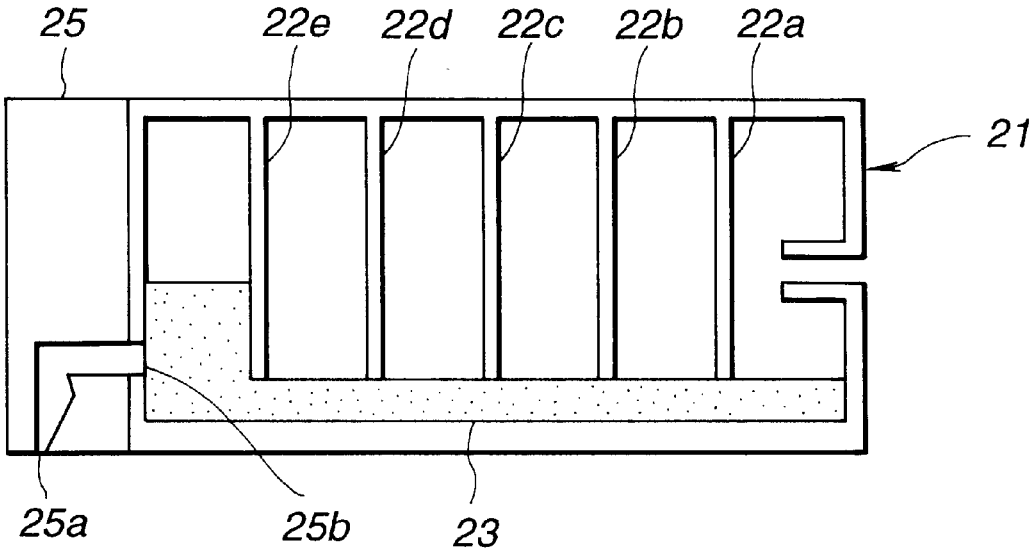
FIG. 7 is a sectional view of a third example of an ink container applicable to the present invention.

FIG. 7 is a longitudinal sectional view of a third example of an ink container applicable to this invention. In this example, a porous member 23 is disposed between each partition plate 22*a*–22*e*, as in the first example. However, in the present example it extends in the sixth chamber 6*f* to cover the supply port 25*b* leading to the ink discharge port 25*a* of the recording head 25. Therefore, remaining ink in the container body 21 can be readily introduced to the ink discharge port 25*a*. In other respects, this example similar to the first example, with like elements numbered in the 20's in this example.

Figure 8:
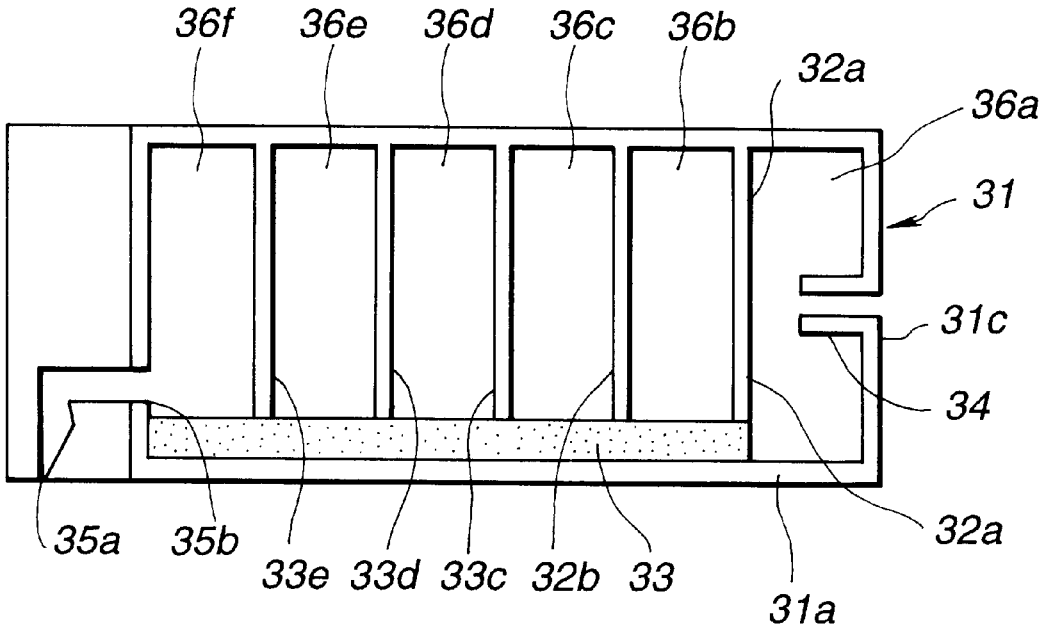
FIG. 8 is a sectional view of a fourth example of an ink container applicable to the present invention.

FIG. 8 is a longitudinal sectional view of a fourth example of an ink container applicable to the invention. In this example, a porous member 33 extends from an open end of the first partition plate 32*a* along the bottom wall 31*a* of the container body 31, but there is no porous material on the bottom wall 31*a* of the first chamber 36*a*. In other respects, this example is similar to the first example, with like elements being numbered in the 30's in this example.

Figure 9:
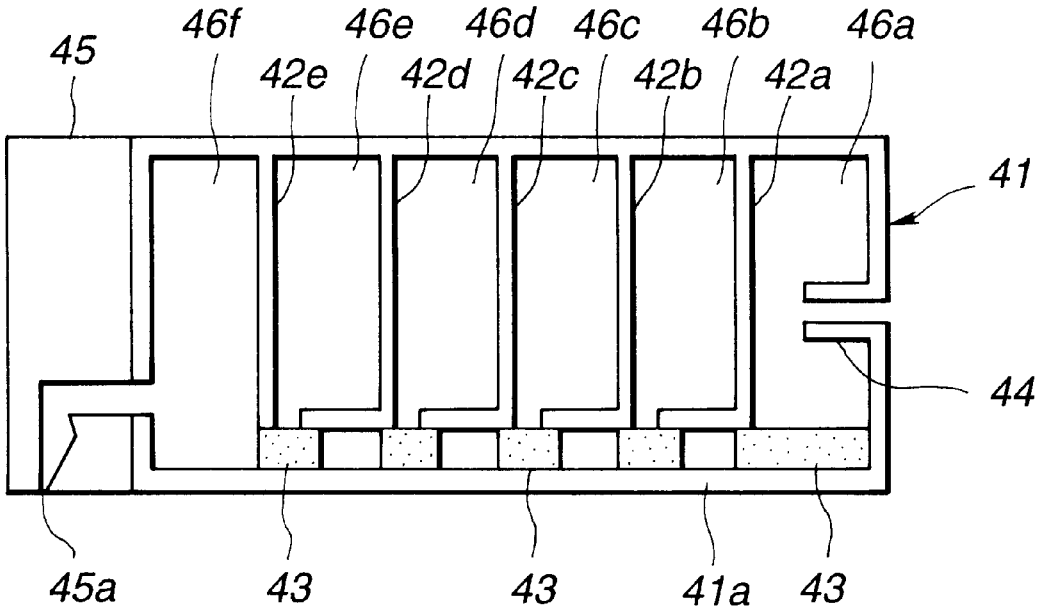
FIG. 9 is a sectional view of a fifth example of an ink container applicable to the present invention.

FIG. 9 is a longitudinal sectional view of a fifth example of an ink container applicable to the present invention. Like elements in this example are numbered in the 40's as compared to their counterparts in the first example. In this example, open ends of the partition plates 42*a*–42*d* facing the bottom wall 41*a* are L-shaped, with porous members 43 between the bottom wall 41*a* and open ends of the partition walls 42*a*–42*e*. In addition, the bottom wall of the chamber 46*a* has a porous member 43 in it. In this example, the total volume of the porous members 43 is small and the amount of usable ink is increased as compared to the first example.

Figure 10:
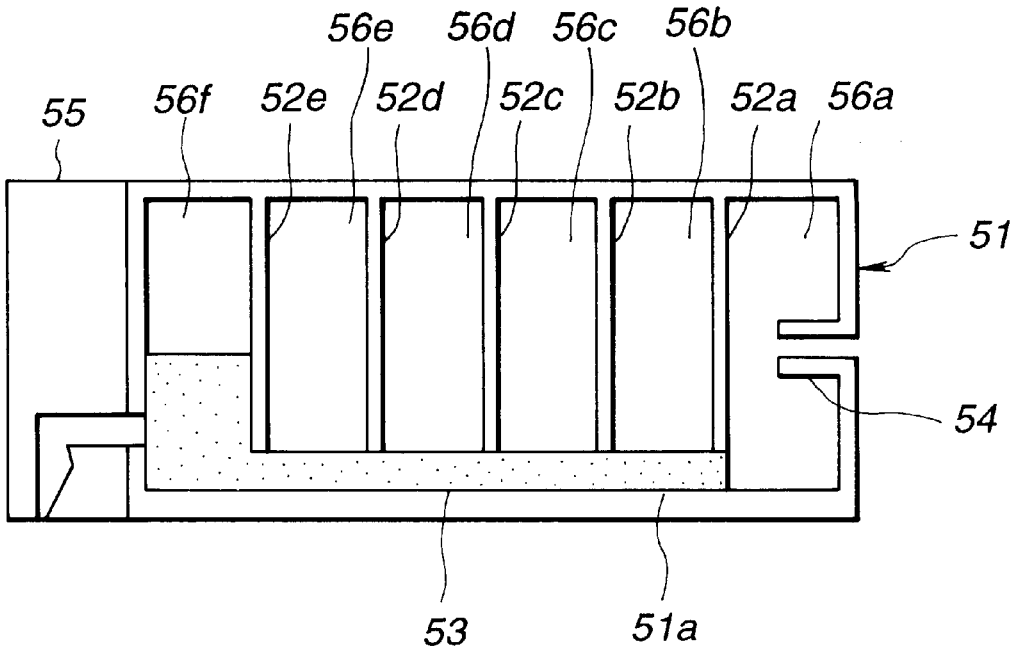
FIG. 10 is a sectional view of a sixth example of an ink container applicable to the present invention.

FIG. 10 is a longitudinal sectional view of a sixth example of an ink container applicable to the invention. This example is similar to the third example shown in FIG. 7, with like elements numbered in the 50's, but there is no porous member 53 at the bottom wall 51*a* of the first chamber 56*a* with this structure, so the amount of usable ink can be increased as compared to the fourth example.

Figure 11:
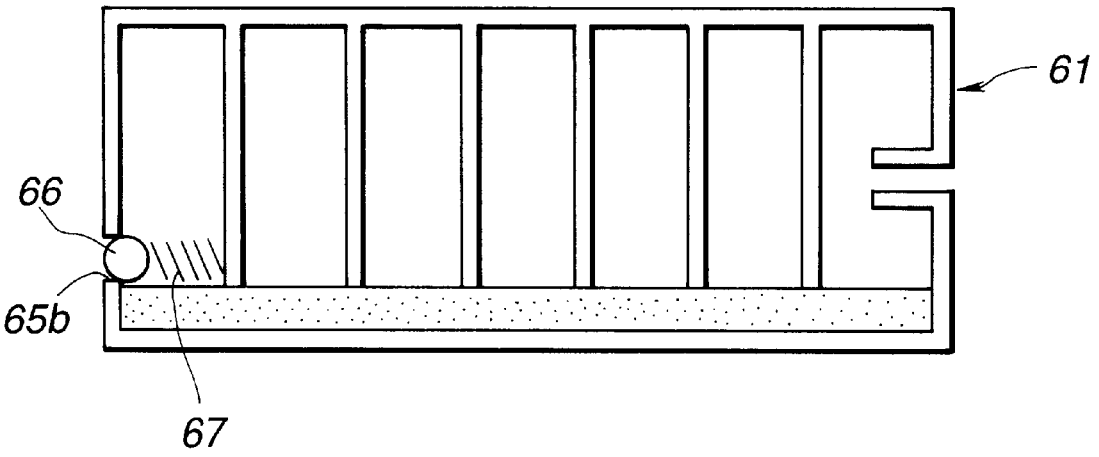
FIG. 11 is a sectional view of a seventh example of an ink container applicable to the present invention.

As noted above, the container may be separable from the recording head. FIG. 11 is a schematic view of a seventh example of an ink container, incorporating such structure. The supply port 65*b* formed in the container main body 61 is closed by a ball 66 normally urged to the outlet port 65*b* by a spring 67. The ball is pushed back against the spring by a part of the recording head when it is mounted to the container.

Figure 12:
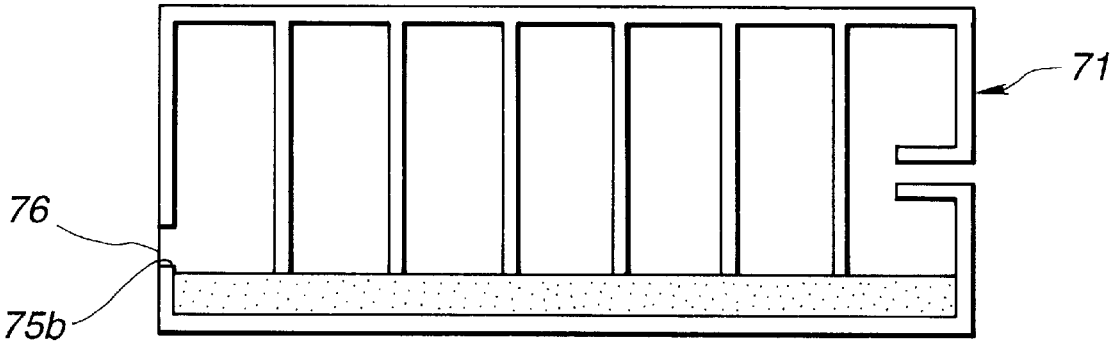
FIG. 12 is a sectional view of an eighth example of an ink container applicable to the present invention.

FIG. 12 shows an eighth example of an ink container, which can also be used with a separable recording head. The outlet port 75*b* of the container body 71 is closed by a closing sheet 76, which is either peeled off or punctured by a part of the recording head when it is mounted to the container.

Figure 13:
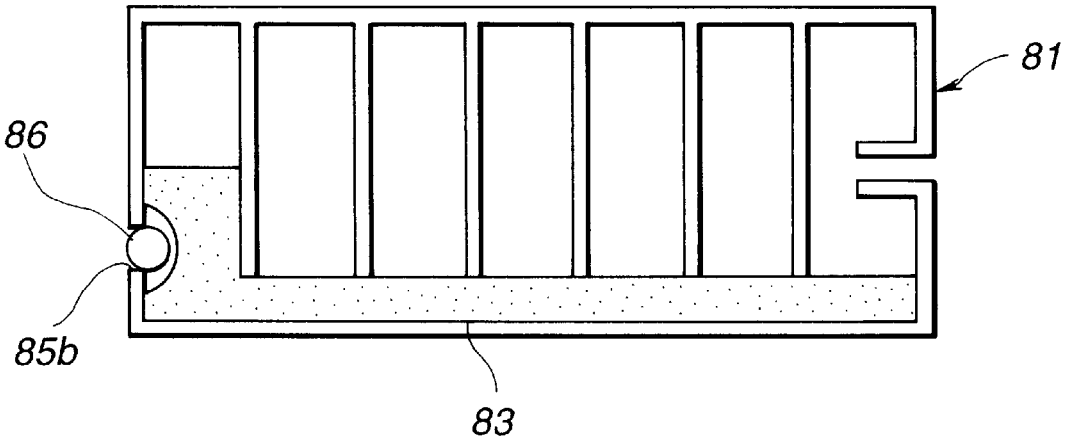
FIG. 13 is a sectional view of a ninth example of an ink container applicable to the present invention.

FIG. 13 shows a ninth example of an ink container, in which the outlet port 85*b* of the container body 81 is closed by a ball 86 normally urged to the outlet port 85*b* by the porous member 83 disposed adjacent to the outlet port. The ball is then pushed out of the way by a part of the recording head, as in the seventh example discussed above in connection with FIG. 11.

FIGS. 14A–14H show various modifications of the position and shape of the porous members used in the above examples. For purposes of illustration, these figures are depicted as sectional views of a container like that shown in FIG. 3 taken along a line 14—14 in FIG. 3.

Figure 14A:
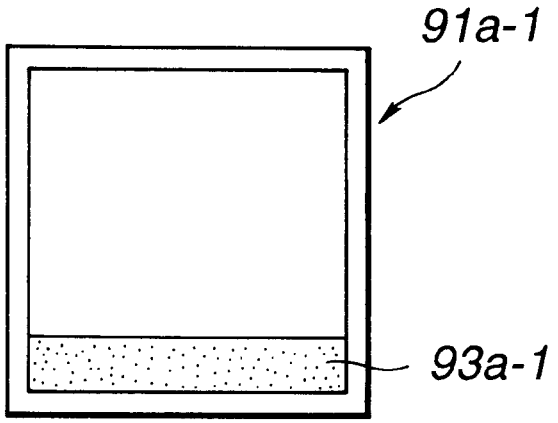
FIGS. 14A–14H are cross-sectional views of additional variations in ink container structure illustrated at a section taken along a line 14—14 in FIG. 4.

In FIG. 14A, a container body 91*a*-1 has a porous member 93*a*-1 of the same material at the same position as in the foregoing examples, that is, at the bottom wall of the container. Such a porous member is operable in all positions except for an upside down position, that is, a position in which the porous material 93*a*-1 is at the top.

Figure 14B:
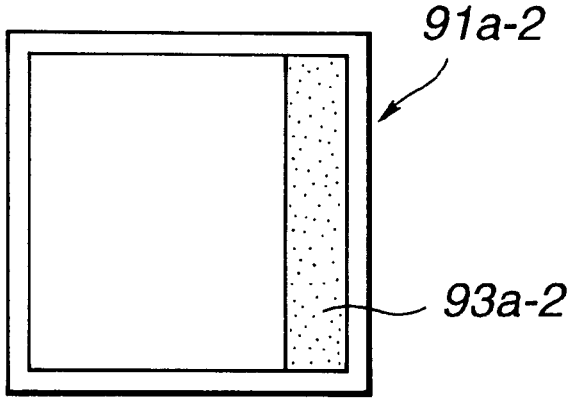
Figure 14C:
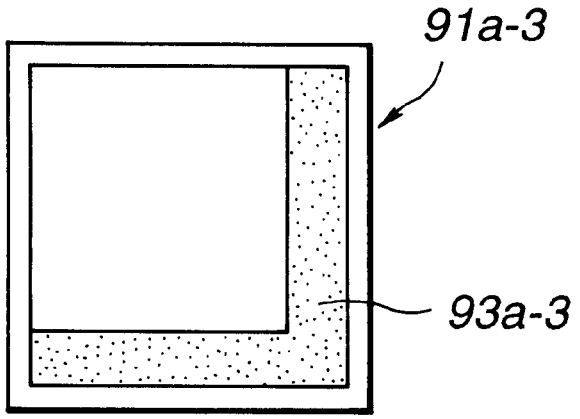
Figure 14D:
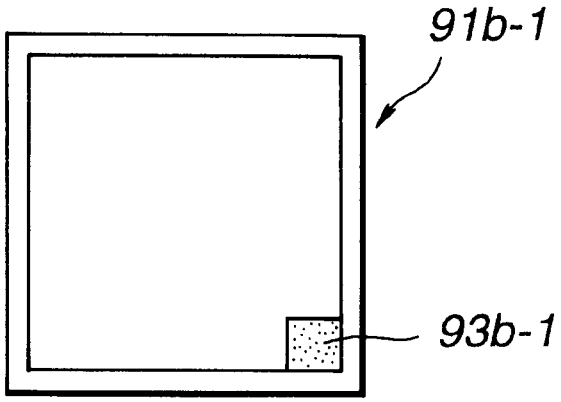
Figure 14E:
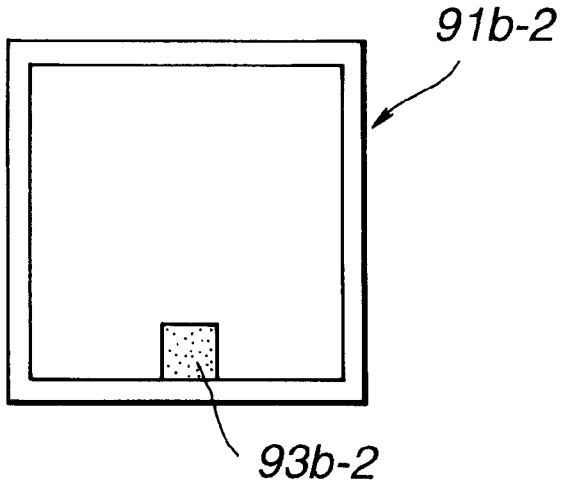

FIG. 14B shows a liquid container body 91*a*-2 having a porous member 93*a*-2 rotated by 90° from the position in FIG. 14A. FIG. 14C shows a container body 91*a*-3 having an L-shaped porous member 93, which is accordingly operable in any position. FIG. 14D shows an example having a rod-like porous member 93*b*-1 at a corner of the container body 91*b*-1. FIG. 14E shows such a rod-like porous member 93*b*-2 at a central portion of a wall of the container body 91*b*-2; this is operable with a printer maintained in a normal orientation.

Figure 14F:
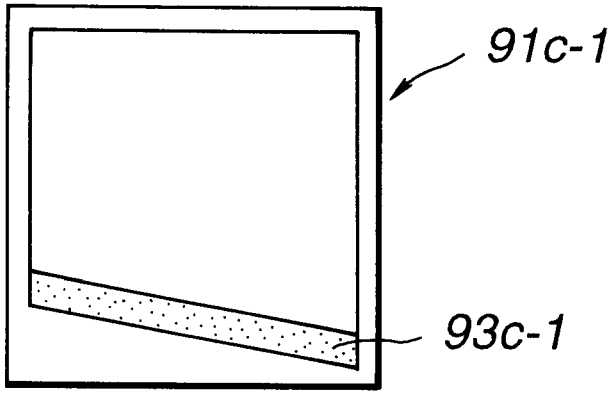
Figure 14G:
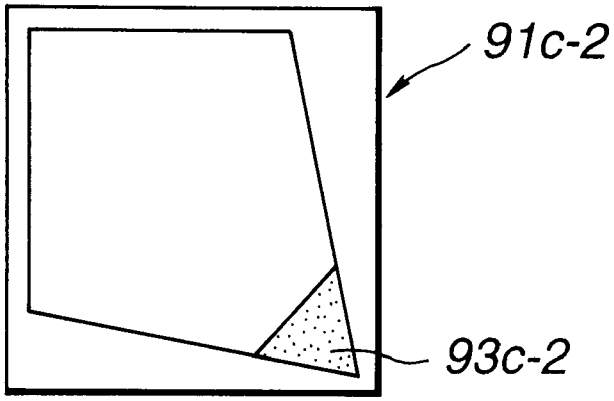
Figure 14H:
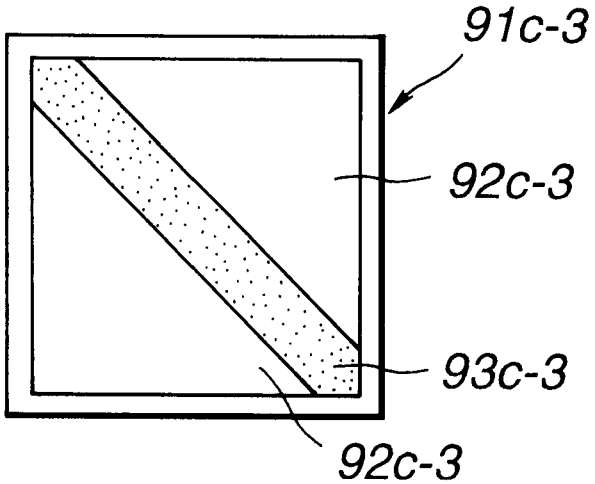

In FIG. 14F the bottom surface of the container body 91*c*-1 is inclined, and the porous member 93*c*-1 is disposed along that inclined surface. In FIG. 14G the bottom and right side surfaces of the container body 91*c*-2 are inclined, and at the corner, a triangular cross-section porous member 93*c*-2 is disposed. In FIG. 14H the porous member 93*c*-3 is disposed between triangular partition plates 92*c*-3 in the container body 91*c*-3.

The foregoing examples all have six chambers, but there can be any number of chambers in excess of one, as described hereinbefore. However, since the chamber having the air vent does not contain ink in the initial state, if the number of chambers is small, the ink capacity is not very large. If the number of chambers is too large considering the overall dimensions of the container, the volume occupied by the partition walls increases, with a loss in ink capacity, again. In consideration of these factors, the number of the chambers can be properly determined by one skilled in the art.

The volume of each of the chambers may be any suitable value, but it is preferable that the chamber having the air vent has a volume which is at least 0.6 times the volume of the maximum volume of any other chamber. This is because ink leakage must be prevented even when the air in the container expands or contracts as a result of any temperature or pressure change which might possibly occur under normal ink container use or handling. In order to provide smooth ink supply, the size of the chambers is preferably uniform, or they may also be increased toward the supply port.

A preferable porous material constituting the porous member 3 is polyurethane foam material. Such polyurethane foam material can be produced by reacting polyether polyol, polyisocyanate and water with a foaming material, catalyst, coloring agent or additives, if desired, by which a high polymer material having a great number of pores is produced. This is cut into a block of a desired size, and the block is immersed in an atmosphere of flammable gas. By explosion of the gas, film materials are removed from between the cells in the block.

Table 1 shows the results of evaluation of properties of respective ink containers using as the porous material polyether polyurethane foam with various porosities. The ink container evaluated was similar to the first example shown in FIGS. 3 and 4. That is, the porous member continuously extended from the first chamber to the sixth chamber, and was compressed between the bottom surfaces of the partition plates 2*a*–2*e* and the bottom surface la of the container 1 without clearance therebetween.

The packing degree is expressed as a ratio T2/T1 (=compression ratio: K), where T1 is a distance between the inside bottom surface of the ink container and the bottom surface of the partition plates 2*a*–2*e*, and T2 is a thickness of the porous member before insertion therebetween. A value of K larger than one means the porous material is compressed between a partition plate and the bottom of the ink container, whereas a value less than one means there is a gap between the porous member and the partition plate or the bottom surface of the ink container. For example, when the ratio K is 0.8, a gap exists between the partition plate and the bottom surface of the ink container, and reverse flows of the air and ink can occur, that is, air can flow from the first chamber 6*a* to the second chamber 6*b*, and ink can flow from the second chamber 6*b* to the first chamber 6*a*.

If ambient conditions change, particularly if the temperature rises, under this condition, the air expands and an amount of ink corresponding to the increase in volume of the air moves from the second chamber 6*b* to the first chamber 6*a*. If, however, the first chamber already contains ink, it is possible that the total amount of ink will exceed the capacity of the first chamber ink will leak through the air vent 4.

If, on the other hand, the volume of K is too large, the porosity distribution becomes sufficiently non-uniform that ink will remain in the porous material.

Porosity P is defined as the number of cells along one linear inch of the porous material ($inch^{-1}$). In evaluation tests, the compression ratio K was 1.5, while the porosity of the porous material was changed, and the porous materials were evaluated for response of ink supply and resistance to vibration as shown hereinafter. In Table 1, "non-compression" refers to the portion of the porous material where it is not compressed, which was seven times as large as the portion which was sandwiched between the partition plates and the bottom plate. That is, in the direction depicted in FIG. 4, the width of the porous member in a chamber is seven times the width of the porous member compressed by a partition plate.

(1) Ink supply response

This is indicative of whether a proper amount of ink (not too large and not too small) can be supplied to the recording head connected to the ink container during the recording operation.

The recording head had 60 nozzles each ejecting approx. 100 pl (liters$\times 10^{-6}$), operated at an ejection frequency of 4 kHz. All of the 60 nozzles were actuated (solid image printing). In the evaluation tests, when 10 A4 size sheets were recorded, the evaluation was "G", and when ejection failure occurred before 10 sheets were completed, the evaluation was "N".

(2) Vibration resistance

The ink container connected with the same recording head was positioned vertically with the recording head at the bottom, and was vibrated vertically for 1 hour at 2G acceleration and 10 Hz. When the ink did not leak through the air vent or the nozzle, the evaluation was "G", and when the leakage occurs, the evaluation was "N".

TABLE 1

| Test materials | Porosity of noncompressed portion ($inch^{-1}$) | Porosity of portion between walls ($inch^{-1}$) | Property of porous material (1) Supply Responsitivity | (2) Durability |
|---|---|---|---|---|
| 1 | 70 | 105 | G | N |
| 2 | 90 | 135 | G | N |
| 3 | 100 | 150 | G | G |
| 4 | 120 | 180 | G | G |
| s | 150 | 225 | G | G |
| 6 | 160 | 240 | G | G |
| 7 | 165 | 248 | G | G |
| 8 | 180 | 270 | G | G |
| 9 | 200 | 300 | G | G |
| 10 | 210 | 315 | N | G |
| 11 | 220 | 330 | N | G |
| 12 | 240 | 360 | N | G |

As described in the foregoing, the plural chambers communicate with each other only through a porous material, and therefore there is a high degree of latitude in the orientation of the ink container without ink leakage, and such leakage due to changes in ambient is also suppressed. Accordingly, ink supply is stabilized, and since ink capacity is large for the size of the container, the size of the ink container can be reduced. In addition, a suitable negative pressure in the container can be maintained by a construction that is easy to manufacture.

Next, preferred embodiments of devices for detecting residual ink quantity according to this invention will be described in detail with reference to the accompanying drawings.

Figure 15:
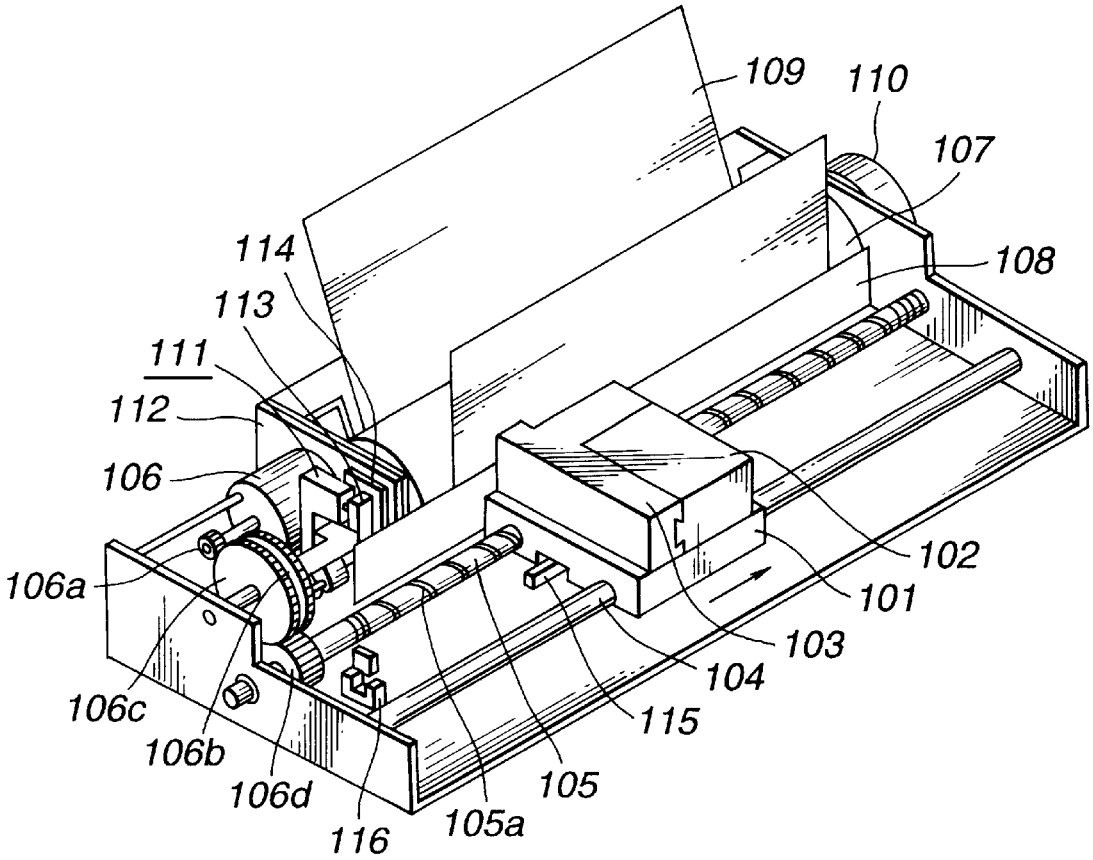
FIG. 15 is a perspective view of an ink jet recording apparatus having mounted thereon an ink container.

Referring to FIG. 15, an ink jet recording apparatus using the recording head and ink container like that depicted in FIGS. 3 and 4 will be described. It will be appreciated that ink containers in accordance with the other examples discussed above could be used as well.

Figure 20:
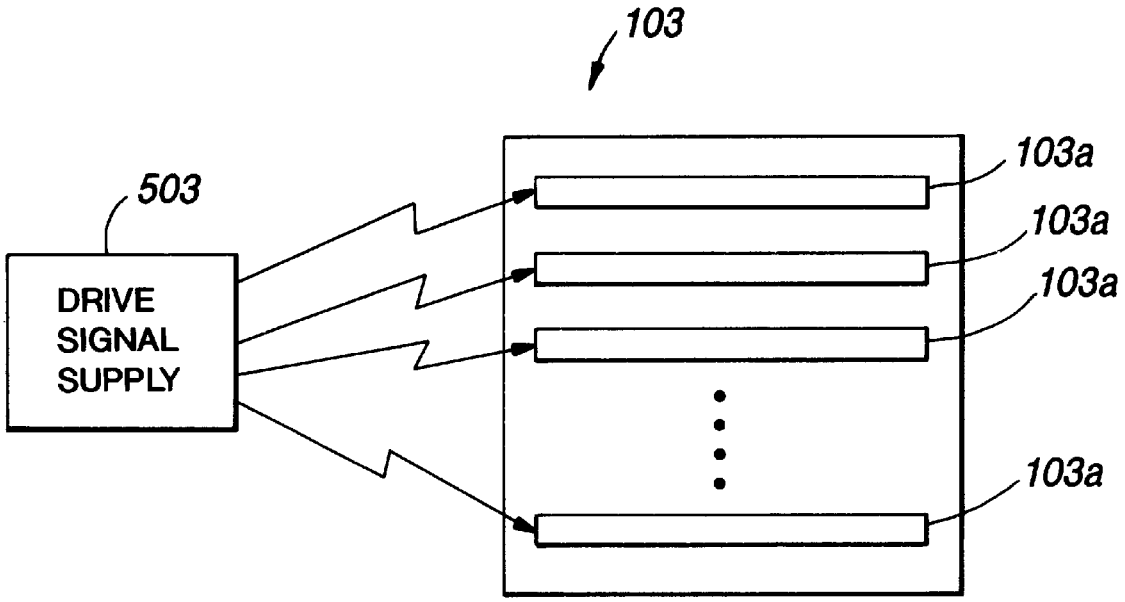
FIG. 20 is a schematic representation of driving of the thermal energy convertors in the recording head by supplying drive signals.

The recording head 103 may be an ink jet head which discharges ink by the use of heat energy, which is preferably a head comprising heat energy generating elements for generating the heat energy supplied to the ink, thereby changing the state of the ink and discharging the ink through ejection ports. As shown in FIG. 20, drive signals for recording are applied to the heat energy generating elements 103*a* of the recording head 103 from drive signal supply circuitry 503.

A recording head 103 and an ink container 102 according to any one of the above examples are joined so as to constitute a recording head unit. The recording head unit is carried on a carriage 101 guided by a guiding shaft 104 and a lead screw 105 having a helical groove 105*a*. In an alternative arrangement, the ink container may be mountable to the recording head. The recording head 103 may be provided with a pipe or rod not shown, and when the ink container cassette is mounted, the pipe or rod is inserted into a supply port of the ink container, like the arrangement shown FIG. 11, for example.

The lead screw 105 is rotated in the forward and backward directions by a reversible motor 106 through gears 106*a*, 106*b*, 106*c* and 106*d*. The carriage 101 is reciprocated in the direction indicated by an arrow and in the opposite direction through an unshown pin on the cartridge 101 being in engagement with the helical groove 105*a*. Switching between forward and backward rotation of the driving motor 106 is effected in response to arrival of the carriage at a home position, which is detected by a combination of a lever 115 on the carriage 101 and a photocoupler 116 on the apparatus body.

Recording material in the form of a sheet of paper 109 is contacted to a platen 107 by a confining plate 108. The sheet faces the recording head 103 and is advanced by an unshown sheet feeding roller driven by a sheet feeding motor 110.

A recovery unit 111 functions to remove foreign matter or increased-viscosity ink in the ejection port of the recording head 103 so as to recover the regular ejection performance. The recovery unit 111 comprises a capping member 113 in communication with an unshown suction pump that draws ink through the ejection ports of the recording head 103 when the capping member is in place to remove foreign matter and increased-viscosity ink from the ejection ports. Between the recovery unit 111 and the platen 107, there is provided a cleaning blade 114 which is movable toward and away from the recording head 103 along a guiding member 112. A free end of the cleaning blade 114 is effective to remove foreign matter and ink droplets deposited on the ejection port surface of the recording head.

Figure 16:
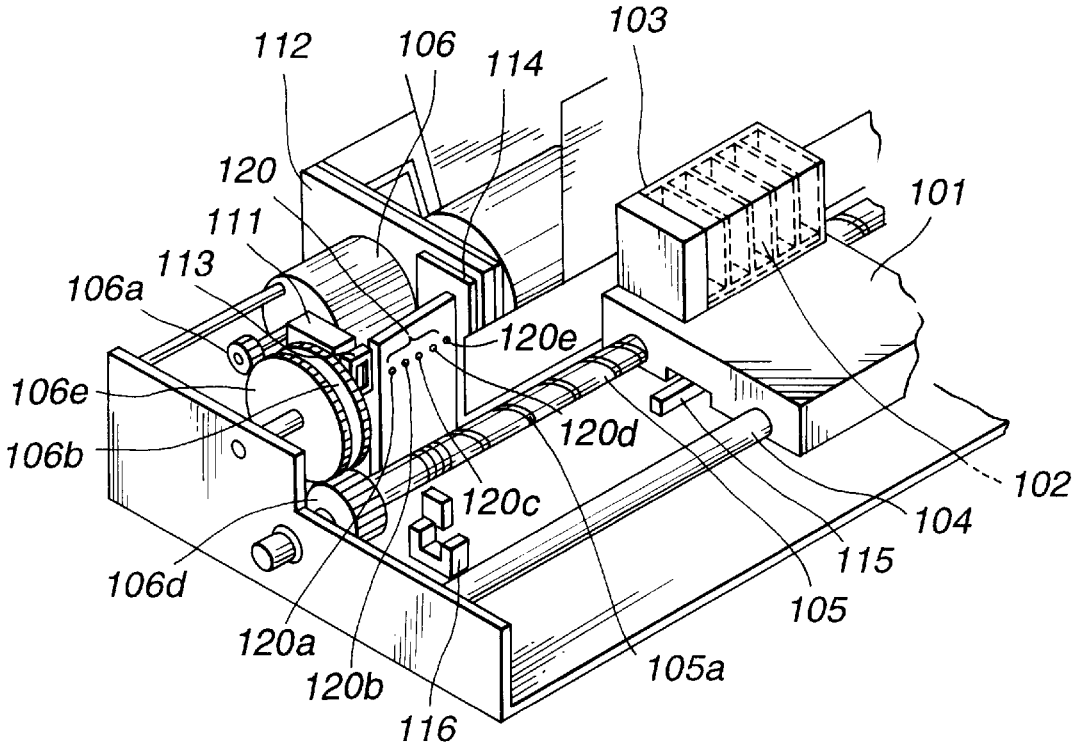
FIG. 16 is a perspective view of an ink jet printer according to a first embodiment of the present invention.

Next, a first embodiment of a device for detecting a decrease in the amount of ink will be described with reference to FIG. 16, which is a perspective view of that part of an ink jet printer having the device.

The ink container 102 has the above-mentioned plural chambers communicating with each other only through a continuous porous material and the ink container is made of transparent polypropylene.

During printing, the carriage 101 having the recording head 103 and the ink container 102 is reciprocated in both directions by rotation of the lead screw 105 in the forward and backward directions. During a non-printing time period, the carriage 101 is moved and positioned where the capping member 113 covers the ejection ports of the recording head 103.

Photosensors 120*a*–120*e* are provided adjacent the capping member 113 such that each photosensor corresponds to each ink chamber of the ink container 102, respectively. The photosensors preferably are light-receiving elements such as phototransistors.

Since at least one portion of each ink chamber in the ink container 102 is transparent, the light amount passing through the ink container is different depending on whether or not there is ink in the ink container 102. The light passing through the ink container or reflected from the ink is received by the photosensor and based on the amount of light received by the photo-sensor, judgment means such as a microcomputer judges the existence of ink in the ink chamber of the ink container. When the ink chamber is full, the amount of light received by the photosensor is less than when the amount of ink in the ink chamber is low, since more light passes through the ink container when the ink quantity is low.

Figure 17:
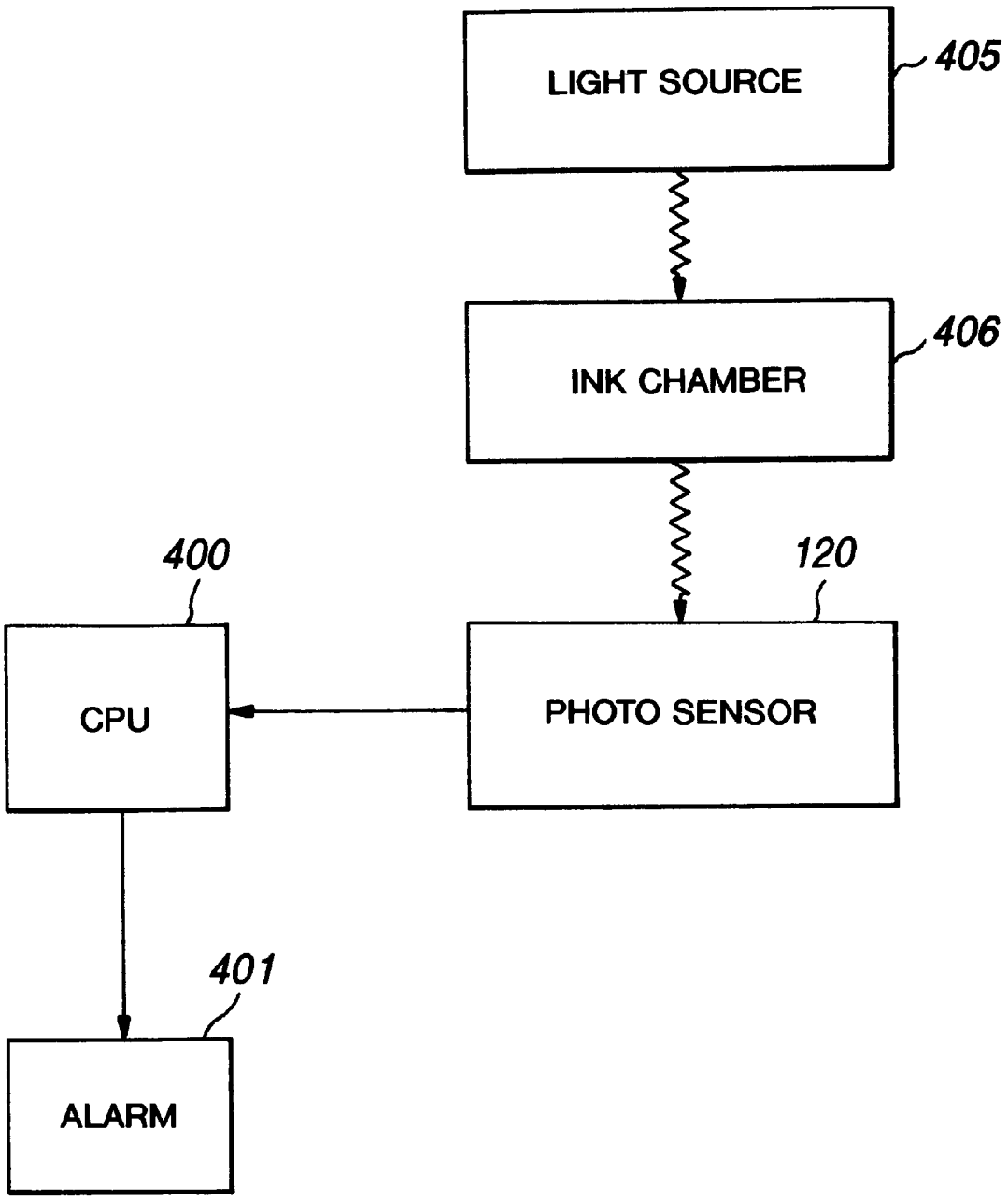
FIG. 17 is a schematic block diagram showing a device for detecting a decrease in the amount of ink according to the present invention.

FIG. 17 is a schematic block diagram showing a device for detecting a decrease in the amount of ink according to this invention. In FIG. 17, reference numeral 120 denotes a photosensor, reference numeral 400 denotes a CPU (central processing unit), which constitutes judging means, and reference numeral 401 denotes alarm means. A light source 405 transmits light through the ink chamber 406 to the photosensor 120. The CPU 400 judges whether the ink amount is sufficient based on a signal output from the photosensor 120. Therefore, when the total light amount received by photosensors 120*a*–120*e* in FIG. 16 is under a threshold level, the CPU 400 judges that the ink amount is low. An operator is notified of this condition by the alarm means 401, which can be a light emitting diode. According to this embodiment, the ink amount can be detected anytime when the carriage is in a waiting position during any non-printing operation of the printer.

Figure 18:
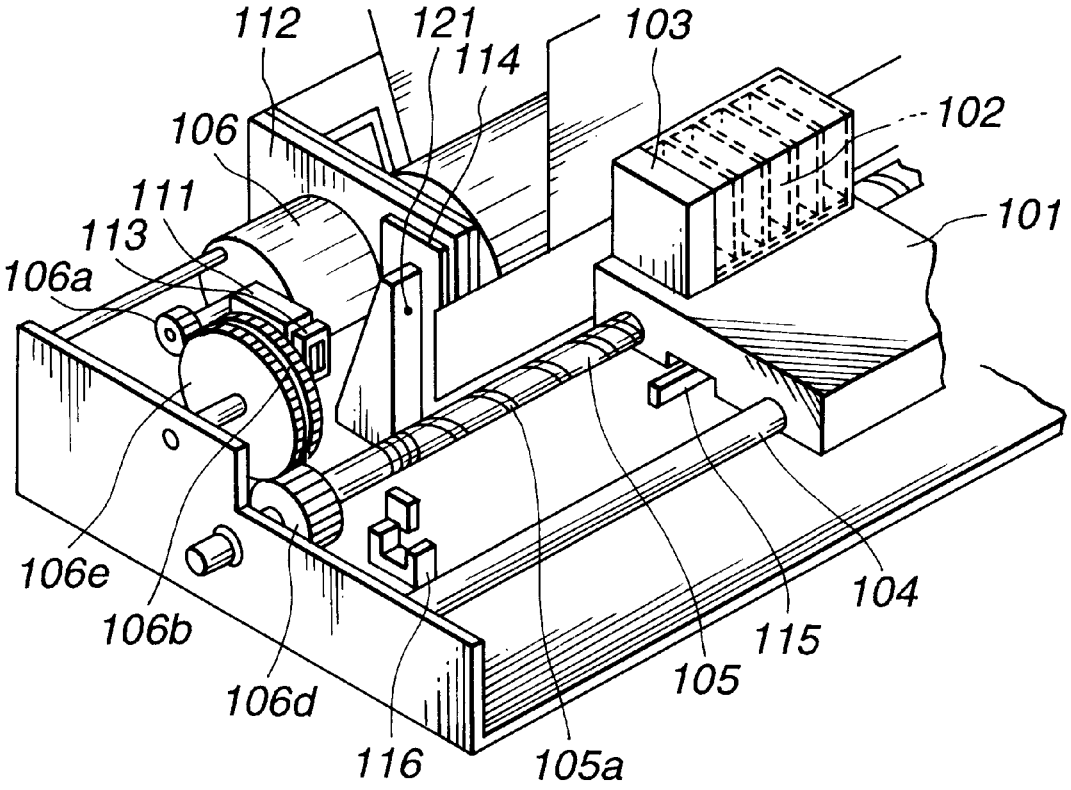
FIG. 18 is a perspective view of an ink jet printer according to a second embodiment of the present invention.

A second embodiment of the invention shown in FIG. 18 differs from the first embodiment in that there is only one photosensor 121. In this embodiment, though the ink amount in all of the ink chambers of the ink container 102 cannot be detected at once when the carriage is in the waiting position, operation of the photosensor 121 in synchronization with the movement of the carriage 101 can enable the ink level in all of the chambers to be detected. That is, in FIG. 18, when the carriage 101 is moving from the right to the left, the ink chambers are also being moved, and by operating the photosensor 121 when the ink chamber closest to the recording head 103 passes in front of the photosensor 121, the ink in the ink chamber closest to the recording head 103 can be detected. Next, by operating the photosensor 121 when the second ink chamber passes in front of the photosensor 121, the ink in the second chamber can be detected. By repeating such detection one after another, the condition of all the ink chambers can be detected.

According to this embodiment, the condition of all the ink chambers cannot be detected simultaneously when the carriage is not moving, but the apparatus can be made compact and manufactured at a low cost since only one photosensor is needed.

Figure 19:
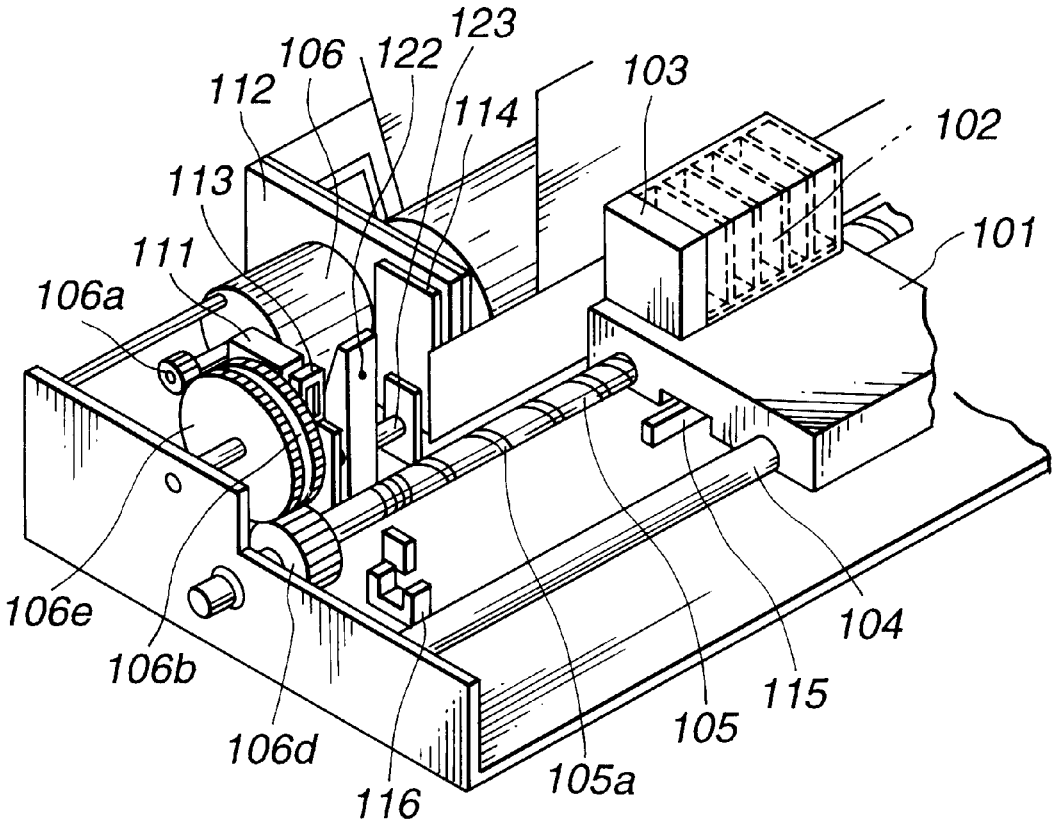
FIG. 19 is a perspective view of an ink jet printer according to the third embodiment of the present invention.

A third embodiment of the invention will be described with reference to FIG. 19. In this embodiment, a photosensor 122 is constructed such that it can be moved right and left along a sensor guide axis 123 by an unshown moving mechanism. The photosensor 122 is moved right and left by the moving mechanism when the carriage 101 is in a waiting position, and the photosensor 122 detects the existence of ink in each ink chamber of the ink container 102. According to this embodiment, a single photosensor is used, but the ink detection can be performed while the carriage is stationary, thus making a more complex control mechanisms unnecessary.

In addition, the moving mechanism of the photosensor in the third embodiment and the moving mechanism of the carriage described in the second embodiment can be combined to carry out the detection.

In the above embodiment, there are five ink chambers, but the number is optional as discussed above. In addition, the photosensors can be arranged in accordance with the number and the size of ink chambers. Moreover, photosensors can be provided on a carriage rather than on a printer body.

In the above embodiments, the existence of ink is detected in all the ink chambers, but there is no necessity to detect all the ink chambers, and the detection can be made for less than all of the ink chambers. For example, since ink level in plural ink chambers becomes low from ink chamber to ink chamber, by detecting only the ink chamber closest to the recording head, CPU 400 can effectively detect a decrease in the amount of ink in the ink container just by detecting the condition of the last chamber.

In addition, since the volume of ink that can be contained in an ink chamber is known, a determination by CPU 400 of the number of ink chambers containing a predetermined amount of ink will provide an indication of ink usage, and consequently residual ink, as it occurs.

In the above embodiments, in the event that the material of the ink container is fully transparent, or sufficient optical contrast can be obtained by using a dark ink color, such as black, it may not be necessary to provide an auxiliary source of light. However, in case the material of the ink container is less than fully transparent, the ink is a light color, or the recording apparatus is so constructed that the container is shielded from ambient light, it may be difficult to carry out proper detection using only a photosensor. In such a case, it is preferable to provide an auxiliary source of light. The manner of arranging the auxiliary light source is optional provided sufficient contrast can be obtained. As an auxiliary source of light, an electric bulb, a fluorescent light, a laser diode or a light emitting diode can be used.

It is not necessary to make all parts of the ink container transparent, although at least that portion of the ink container to be used for the detection should be made of transparent material.

In the above embodiments, though a photosensor is used as a detecting means, other known detecting means can be used instead of a photosensor.

The present invention is particularly suitable for use with an jet recording head and recording apparatus wherein thermal energy by an electrothermal transducer, laser beam or the like is used to cause a change of state of the ink to eject or discharge the ink. This is because high density picture elements and high resolution recording can be provided.

The typical structure and operational principles for such apparatus are preferably those disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond nucleation boiling, by which the thermal energy is provided by the electrothermal transducer to produce film boiling on the heat portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore the liquid (ink) is ejected with quick response. The driving signal in the form of the pulse is preferably such as disclosed in U.S. Pat. Nos. 4,463,359 and 4,345,262. In addition, the rate of temperature rise of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform a recording operation with certainty and at high efficiency irrespective of the type of the recording head.

The provision of recovery means and/or auxiliary means for preliminary operation are preferable, because they can further stabilize the effects of the present invention. As for such means, there are capping means and cleaning means for the recording head (discussed above), pressing or sucking means, preliminary heating means, which may be the electrothermal transducer, and additional heating elements or a combination thereof. Also, means for effecting preliminary ejection (that is, ejection not for recording) can stabilize the recording operation.

Regarding variations in the recording head, it may be a single head corresponding to a single color ink, or it may be plural heads corresponding to a plurality of ink materials having different recording colors and/or densities. The present invention is effectively applicable to an apparatus having at least one of a monochromatic mode mainly with black, a multi-color mode with different color ink materials and/or a full-color mode using a mixture of the colors, using an integrally formed recording unit or a combination of plural recording heads.

The ink jet recording apparatus may be used as an output terminal of an information process apparatus such as computer or the like, as a copying apparatus combined with an image reader or the like, or as a facsimile machine having information sending a receiving functions.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A device comprising:

an ink container having plural ink chambers separated by at least one partition in said ink container, said partition forming an opening to provide an ink path between said plural ink chambers, said plural ink chambers being positioned in a side-by-side arrangement having a first ink chamber at an end thereof and a second ink chamber at another end thereof so that said ink path connects said plural ink chambers in a series, and said ink container having an air vent for communicating said first ink chamber with atmosphere and an ink supply port for supplying ink from said second ink chamber, wherein said ink path provides for an ink flow to said ink supply port that empties each of said plural ink chambers in said series sequentially as ink is supplied from said ink supply port, and wherein at least the first and second ink chambers each include a light-transmissible portion;

positioning means for positioning said ink container;

a plurality of photosensors for optically detecting ink through said light-transmissible portions when said ink container is positioned proximate to said photosensors; and detecting means for determining a number of ink chambers containing a predetermined amount of ink based on a result of detection by said plurality of photosensors, thereby detecting a residual ink quantity in said ink container as said plural ink chambers are emptied sequentially, wherein each of said plurality of photosensors is positioned to detect ink in respectively positioned ink chambers.

2. A device according to claim 1, further comprising a light source which emits light received by said plurality of photosensors.

3. A device according to claim 1, wherein said ink path is filled with a porous member.

4. A device according to claim 3, wherein said porous member is disposed in said plural ink chambers and is continuous.

5. A device according to claim 3, wherein said porous member extends along at least one wall of said ink container.

6. An ink jet recording apparatus using a recording head which emits ink toward a recording medium, the apparatus comprising:

an ink container having plural ink chambers including a first ink chamber and a second ink chamber separated by at least one partition in said ink container, said partition forming an opening to provide an ink path between said plural ink chambers, said ink path connecting said ink chambers in a series, said ink container having an air vent for communicating said first ink chamber with atmosphere and an ink supply port for supplying ink from said second ink chamber to said recording head, wherein said ink path provides for an ink flow to said ink supply port that empties each of said plural ink chambers in said series sequentially as ink is supplied from said ink supply port, and wherein at least the first and second ink chambers each include a light-transmissible portion;

positioning means for positioning said ink container;

a plurality of photosensors for optically detecting ink through said light-transmissible portions when said ink container is positioned opposite said photosensors;

detecting means for determining a number of ink chambers containing a predetermined amount of ink based on a result of detection by said plurality of photosensors, thereby detecting a residual ink quantity in said ink container as said plural ink chambers are emptied sequentially; and drive signal supply means for supplying a drive signal to said recording head for ink emission, wherein each of said plurality of photosensors is positioned to detect ink in respectively positioned ink chambers.

7. An ink jet recording apparatus according to claim 6, wherein said recording head has thermal energy converters for generating thermal energy as energy for use in discharging ink.

8. A method comprising the steps of:

providing an ink container having plural ink chambers including a first ink chamber and a second ink chamber separated by at least one partition in said ink container, said partition forming an opening to provide an ink path between said plural ink chambers so that said ink path connects said ink chambers in a series, and said ink container having an air vent for communicating said first ink chamber with atmosphere and an ink supply port for supplying ink from said second ink chamber to a recording head, wherein said ink path provides for an ink flow to said ink supply port that empties each of said plural ink chambers in said series sequentially as ink is supplied from said ink supply port, and wherein at least the first and second ink chambers each include a light-transmissible portion;

optically detecting ink through said light-transmissible portions using a plurality of photosensors; and determining a number of ink chambers containing a predetermined amount of ink based on a result of said step of optically detecting, thereby detecting a residual ink quantity in said ink container as said plural ink chambers are emptied sequentially, wherein each of said plurality of photosensors is positioned to detect ink in respectively positioned ink chambers.

9. An ink jet recording apparatus using a recording head which emits ink toward a recording medium, the apparatus comprising:

an ink container having plural ink chambers including a first ink chamber and a second ink chamber separated by at least one partition in said ink container, said partition forming an opening to provide an ink path between said ink chambers so that said ink path connects said ink chambers in a series, and said ink container having an air vent for communicating said first ink chamber with atmosphere and an ink supply port for supplying ink from said second ink chamber to said recording head, wherein said ink path provides for an ink flow to said ink supply port that empties each of said plural ink chambers in said series sequentially as ink is supplied from said ink supply port, and wherein at least one of said chambers includes a light-transmissible portion;

positioning means for positioning said ink container;

at least one photosensor for optically detecting ink through said light-transmissible portion when said ink container is positioned opposite said photosensor; and detection means for detecting an amount of ink in said ink container according to a detection result of said photosensor, wherein a detection by said detection means is based on a determination of a number of ink chambers which contain a predetermined amount of ink, said determination based on the detected amount of ink, said detection means thereby detecting a residual ink quantity in said ink container as said plural ink chambers are emptied sequentially.

10. An ink jet recording apparatus according to claim 9, further comprising control means for controlling a movement by said positioning means of said ink container relative to said photosensor, said control means controlling said movement based on the detection of ink in each of said ink chambers sequentially.

11. A device comprising:

an ink container having plural ink chambers separated by at least one partition in said ink container, said partition forming an opening to provide an ink path between said plural ink chambers, said plural ink chambers being positioned in a side-by-side arrangement having a first ink chamber at an end thereof and a second ink chamber at another end thereof so that said ink path connects said plural ink chambers in a series, and said ink container having an air vent for communicating said first ink chamber with atmosphere and an ink supply port for supplying ink from said second ink chamber, wherein said ink path provides for an ink flow to said ink supply port that empties each of said plural ink chambers in said series sequentially as ink is supplied from said ink supply port, and wherein at least one of said chambers includes a light-transmissible portion;

positioning means for positioning said ink container;

at least one photosensor for optically detecting ink through said light-transmissible portion when said ink container is positioned opposite said photosensor; and detecting means for determining a number of ink chambers containing a predetermined amount of ink based on a result of detection by said photosensor, thereby detecting a residual ink quantity in said ink container as said ink chambers are emptied sequentially, wherein said photosensor detects a decrease in an amount of ink in an ink chamber in which said light-transmissible portion is provided, and said positioning means moves each of said ink chambers to a position where said photosensor can detect a decrease in the amount of the ink in each of said ink chambers.

12. A device according to claim 11, further comprising a light source which corresponds to said photosensor.

13. A device according to claim 11, wherein said ink path is filled with a porous member.

14. A device according to claim 13, wherein said porous member is disposed in said plural ink chambers and is continuous.

15. A device according to claim 13, wherein said porous member extends along at least said wall of said ink container.

16. An ink jet recording apparatus using a recording head which emits ink toward a recording medium, the apparatus comprising:

an ink container having plural ink chambers including a first ink chamber and a second ink chamber separated by at least one partition in said ink container, said partition forming an opening to provide an ink path between said ink chambers, said ink path connecting said plural ink chambers in a series, said ink container having an air vent for communicating said first ink chamber with atmosphere and an ink supply port for supplying ink from said second ink chamber to said recording head, wherein said ink path provides for an ink flow to said ink supply port that empties each of said plural ink chambers in said series sequentially as ink is supplied from said ink supply port, and wherein at least one of said chambers includes a light-transmissible portion;

positioning means for positioning said ink container;

at least one photosensor for optically detecting ink through said light-transmissible portion when said ink container is positioned opposite said photosensor;

detecting means for determining a number of ink chambers containing a predetermined amount of ink based on a result of detection by said photosensor, thereby detecting a residual ink quantity in said ink container as said plural ink chambers are emptied sequentially; and drive signal supply means for supplying drive signals for ink emission to said recording head, wherein said positioning means moves each of said chambers to a position where said photosensor can detect a decrease in an amount of the ink in each of said chambers.

17. An ink jet recording apparatus according to claim 16, wherein said recording head has thermal energy converters for generating thermal energy for use in discharging the ink.

18. A detecting method comprising the steps of:

providing an ink container having plural ink chambers including a first ink chamber and a second ink chamber separated by at least one partition in said ink container, said partition forming an opening to provide an ink path between said plural ink chambers so that said ink path connects said ink chambers in a series, and said ink container having an air vent for communicating said first ink chamber with atmosphere and an ink supply port for supplying ink from said second ink chamber to a recording head, wherein said ink path provides for an ink flow to said ink supply port that empties each of said plural ink chambers in said series sequentially as ink is supplied from said ink supply port, and wherein at least one of said chambers includes a light-transmissible portion;

optically detecting ink through said light-transmissible portion using a single photosensor;

moving said ink container so that each of said ink chambers sequentially is opposite said photosensor;

detecting a decrease in an amount of ink in each of said chambers by said single photosensor; and determining a number of said ink chambers containing a predetermined amount of ink based on a result of said step of optically detecting, thereby detecting a residual ink quantity in said ink container as said ink chambers are emptied sequentially.

* * * * *

UNITED STATES PATENT AND TRADEMARK OFFICE

CERTIFICATE OF CORRECTION

PATENT NO. : 5,929,885

DATED : July 27, 1999

INVENTORS : Kazuhiro Nakajima, et al.

It is certified that error appears in the above-identified patent and that said Letters Patent is hereby corrected as shown below:

COVER PAGE

Please insert --[*] Notice: This patent issued on a continued prosecution application filed under 37 C.F.R. 1.53(d), and is subject to the twenty year patent term provisions of 35 U.S.C. 1.54(a)(2).

COLUMN 2

Line 60, "provide" should read --to provide--.

COLUMN 5

Line 65, "la" should read --1a--.

COLUMN 11

Line 37, "a" should be deleted.

COLUMN 12

Line 17, "jet" should read --ink-jet--.

UNITED STATES PATENT AND TRADEMARK OFFICE

CERTIFICATE OF CORRECTION

PATENT NO. : 5,929,885

DATED : July 27, 1999

INVENTORS : Kazuhiro Nakajima, et al.

It is certified that error appears in the above-identified patent and that said Letters Patent is hereby corrected as shown below:

COLUMN 13

Line 20, "sending a" should read --sending and--.

Signed and Sealed this

Fifteenth Day of August, 2000

*Attest:*

*Attesting Officer*

Q. TODD DICKINSON

*Director of Patents and Trademarks*